US008869394B2

(12) United States Patent
Takayashiki et al.

(10) Patent No.: US 8,869,394 B2
(45) Date of Patent: Oct. 28, 2014

(54) METHOD OF CONNECTING ELECTRIC WIRES

(75) Inventors: Yousuke Takayashiki, Susono (JP); Hajime Takada, Susono (JP); Yoshihiko Watanabe, Susono (JP); Kouichirou Matsushita, Makinohara (JP)

(73) Assignee: Yazaki Corporation, Tokyo (JP)

( * ) Notice: Subject to any disclaimer, the term of this patent is extended or adjusted under 35 U.S.C. 154(b) by 271 days.

(21) Appl. No.: 13/201,495

(22) PCT Filed: Feb. 17, 2010

(86) PCT No.: PCT/JP2010/052348

§ 371 (c)(1), (2), (4) Date: Aug. 15, 2011

(87) PCT Pub. No.: WO2010/095646

PCT Pub. Date: Aug. 26, 2010

(65) Prior Publication Data

US 2011/0296683 A1 Dec. 8, 2011

(30) Foreign Application Priority Data

Feb. 17, 2009 (JP) ..... 2009-034472

(51) Int. Cl.

| | |
|---|---|
| ***H01R 43/20*** | (2006.01) |
| ***H01R 4/12*** | (2006.01) |
| ***H01R 4/02*** | (2006.01) |
| *H01R 43/02* | (2006.01) |

(52) U.S. Cl.

CPC ..... *H01R 4/12* (2013.01); *H01R 43/0207* (2013.01); *H01R 4/029* (2013.01)

USPC ..... 29/876; 29/860; 29/863; 29/868

(58) Field of Classification Search

USPC ..... 29/876, 599, 828, 860, 863, 868, 872; 174/84 R, 87, 113 R

See application file for complete search history.

(56) References Cited

U.S. PATENT DOCUMENTS 4,473,715 A * 9/1984 Beinhaur et al. ..... 174/87
5,277,019 A 1/1994 Karhu (Continued)

FOREIGN PATENT DOCUMENTS

CN 1072531 A 5/1993
CN 1379504 A 11/2002

(Continued)

OTHER PUBLICATIONS

International Search Report for PCT/JP2010/052348 dated Mar. 16, 2010 [PCT/ISA/210].

(Continued)

*Primary Examiner* — Thiem Phan
(74) *Attorney, Agent, or Firm* — Sughrue Mion, PLLC

(57) ABSTRACT

There is provided a method of connecting electric wires in which connecting strength is improved, and at the same time, dispersion of the connecting strength can be depressed. The method of connecting electric wires includes a step for removing coatings of a plurality of electric wires 51 thereby to expose conductors 52, a step for holding at least two places of a plurality of the electric wires 51, a step for twisting the conductors together while keeping a distance between the two holding places constant, and a step for welding the conductors by ultrasonic welding.

6 Claims, 10 Drawing Sheets

(56) References Cited

U.S. PATENT DOCUMENTS

| | | | |
|---|---|---|---|
| 5,446,241 | A | 8/1995 | Mackaness et al. |
| 2002/0142676 | A1 | 10/2002 | Hosaka et al. |
| 2008/0032569 | A1 | 2/2008 | Steiner et al. |

FOREIGN PATENT DOCUMENTS

| | | | | | |
|---|---|---|---|---|---|
| CN | 1638195 | A | | 7/2005 | |
| CN | 101001712 | A | | 7/2007 | |
| JP | 63-284780 | A | | 11/1988 | |
| JP | 2005-322544 | | * | 11/2005 | ..... H01R 4/02 |
| JP | 2005-322544 | A | | 11/2005 | |
| WO | 91 18430 | A1 | | 11/1991 | |

OTHER PUBLICATIONS

Office Action, dated Jun. 25, 2013, issued by the State Intellectual Property Office of P.R. China in counterpart Chinese Patent Application No. 201080007871.6.

Office Action issued Jan. 17, 2014, by the Patent Office of the PR of China, in corresponding Chinese Patent Application No. 201080007871.6.

Office Action dated Jul. 2, 2014, issued by the State Intellectual Property Office of P.R. China in counterpart Chinese Patent Application No. 201080007871.6.

* cited by examiner

METHOD OF CONNECTING ELECTRIC WIRES

TECHNICAL FIELD

The present invention relates to a method of connecting electric wires.

BACKGROUND ART

There has been conventionally known a method of connecting electric wires, including a step for stripping off coatings of a plurality of insulated electric wires thereby to expose conductors, and a step for welding the exposed conductors together by ultrasonic welding (For example, Patent Document 1). According to this method of connecting electric wires, it is possible to enhance connecting strength, because the conductors of a plurality of the insulated electric wires are twisted together in the same direction, and then, welded by ultrasonic welding.

PRIOR ART DOCUMENT

Patent Document

Patent Document 1: JP-A-2005-322544

SUMMARY OF INVENTION

Technical Problem

According to the conventional method of connecting electric wires, it is possible to sufficiently enhance the connecting strength, because the conductors are twisted together by more than a quarter rotation in the same direction. However, in the conventional method of connecting electric wires, the conductors are simply twisted together by more than a quarter rotation in the same direction, and therefore, degree of tight contact between the conductors may be varied in some cases. In view of the above, there has been such possibility that the connecting strength of the electric wires can be further improved. Moreover, in the conventional method of connecting electric wires, it sometimes happens that both the electric wires in which the degree of tight contact between the conductors is varied, and the electric wires having no such feature may co-exist. As the results, there has been such possibility that remarkable dispersion in the connecting strength may occur.

The invention has been made in order to solve the above described problems in the conventional method. An object of the invention is to provide a method of connecting electric wires in which connecting strength is further improved, and at the same time, dispersion of the connecting strength can be depressed.

Solution to Problem

The method of connecting electric wires according to the invention has a step for removing coatings of a plurality of the electric wires thereby to expose conductors, a step for holding at least two places of a plurality of the electric wires, a step for twisting the conductors together while keeping a distance between the two holding places constant, and a step for welding the conductors together by ultrasonic welding.

According to the method of connecting electric wires in the invention, there is the step for twisting the conductors together while keeping the distance between the places held by chucks or the like constant, after the preparing step and before the welding step. Therefore, conductor density (a ratio of the conductor with respect to a circumcircle of the conductor which is perpendicular to a longitudinal direction of the electric wires) is enhanced prior to the ultrasonic welding, and energy of ultrasonic oscillation can easily spread among the conductors during the ultrasonic welding. As the results, the conductors are favorably joined together, and connecting strength can be improved. Further, because the energy of the ultrasonic oscillation can easily spread, the electric wires having possibility of improving the connecting strength are decreased in number, and dispersion of the connecting strength can be also depressed.

Moreover, in the method of connecting electric wires according to the invention, it would be preferable that in the twisting step, the conductors are twisted together so that the conductor density may be more than 0.6 and less than 1.0.

According to this method of connecting electric wires, the conductors are twisted together so that the conductor density may be more than or equal to 0.6 and less than 1.0. In case where the conductors are twisted together without keeping the distance between the places held by chucks or the like constant, the conductor density is about 0.4, for example. Therefore, by twisting the conductors together so that the conductor density may be more than or equal to 0.6 and less than 1.0, while keeping the distance between the holding places constant, the density is apparently enhanced, as compared with the case where the distance between the holding places is not kept constant, and the connecting strength can be apparently improved.

Moreover, in the method of connecting electric wires according to the invention, it would be preferable that in the twisting step, the conductors are twisted together so that the conductor density may be more than or equal to 0.8 and less than 0.9.

According to this method of connecting electric wires, the conductors are twisted together so that the conductor density may be more than or equal to 0.8 and less than 0.9. Therefore, the density is apparently enhanced, as compared with the case where the distance between the places held by chucks or the like is not kept constant, and the connecting strength can be apparently improved.

Moreover, in the method of connecting electric wires according to the invention, it would be preferable that in the twisting step, the conductors are twisted together by at least one rotation, while keeping the distance between the holding places constant.

According to this method of connecting electric wires, the conductors are twisted together by at least one rotation, while keeping the distance between the places held by chucks or the like constant. In this case, it is already known that after one rotation, the conductor density is about 0.6, and the connecting strength can be apparently improved. Additionally, there is no necessity of twisting in view of the conductor density, and the connecting strength can be easily improved.

Moreover, in the method of connecting electric wires according to the invention, it would be preferable that in the twisting step, in a state where at least two places of only a conductor part are held after the conductors of a plurality of the electric wires are contacted with one another, at least one place out of the two places is rotated around a longitudinal direction of the electric wires thereby to twist the conductors together, while keeping the distance between the holding places constant.

According to this method of connecting electric wires, in the twisting step, in a state where at least two places of only the conductor part are held after the conductors are contacted with one another, at least one of the two places is rotated around the longitudinal direction of the electric wires. Accordingly, only the conductor part is rotated. In this case, when both the conductor part and the coating part are held and rotated, the distance between the two places becomes longer, and an amount of rotation is increased, for the purpose of enhancing the conductor density by a determined amount. However, because only the conductor part is held and rotated, it is possible to reduce the rotation amount for the purpose of enhancing the conductor density, and to depress an increase of working steps.

Moreover, in the method of connecting electric wires according to the invention, it would be preferable that in the twisting step, in a state where at least one place of the conductor part and at least one place of the coating part are held after the conductors of a plurality of the electric wires are contacted with one another, at least one of the respective places is rotated around the longitudinal direction of the electric wires thereby to twist the conductors together, while keeping the distance between the holding places constant.

According to this method of connecting electric wires, in the twisting step, in a state where at least one place of the conductor part and at least one place of the coating part are held after the conductors are contacted with one another, at least one of the two places is rotated around the longitudinal direction of the electric wires. In case where only the conductor part is held, the distance between the holding places is short. For this reason, it is impossible to excessively increase the rotation amount so that the conductor part may not be damaged. As the results, dispersion of the conductor density may occur with high possibility, due to subtle dispersion of the rotation amount. However, because both the conductor part and the coating part are held, the distance can be secured in the longitudinal direction of the electric wires, as compared with the case where only the conductor part is held, and the rotation amount can be also increased. In this manner, the dispersion of the conductor density even due to subtle dispersion of the rotation amount is decreased. As the results, it is possible to obtain a desired conductor density.

Advantageous Effects of Invention

According to the method of connecting electric wires in the invention, it is possible to improve the connecting strength.

EMBODIMENTS OF INVENTION

Figure 1:
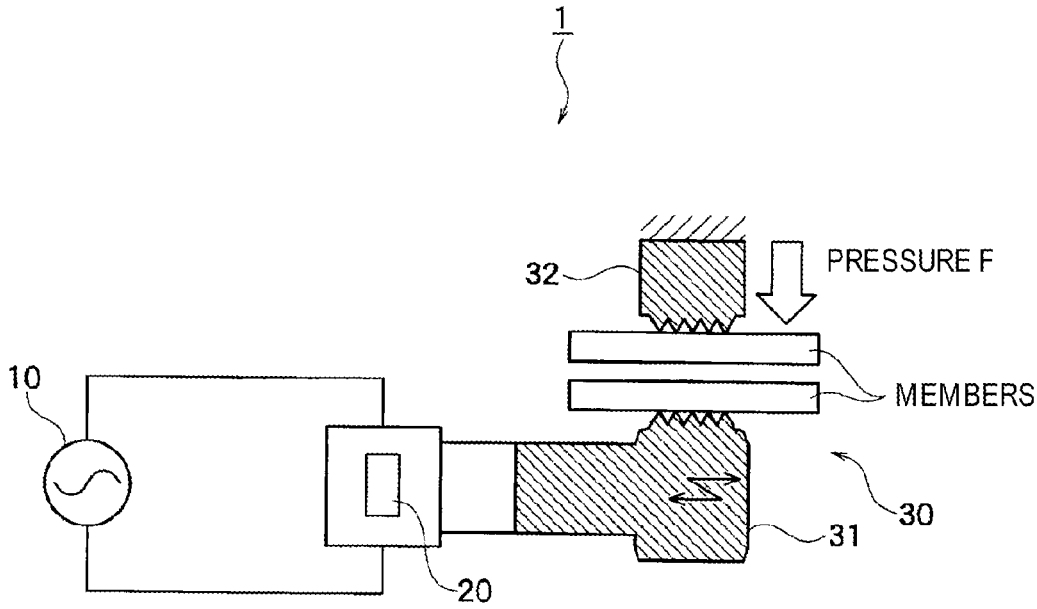
FIG. 1 is a schematic view showing an example of ultrasonic welding.

Now, a preferred embodiment according to the invention will be described referring to the drawings. FIG. 1 is a schematic view showing an example of ultrasonic welding. As shown in FIG. 1, the ultrasonic welding is conducted by using an ultrasonic welding machine 1. Schematically, the ultrasonic welding machine 1 includes a power supply 10, an oscillator 20, and an ultrasonic welding part 30. The power supply 10 is an AC current for conducting the ultrasonic welding in the ultrasonic welding part 30. The oscillator 20 is oscillated by the AC current from the power supply 10. The ultrasonic part 30 has a hone 31 and an anvil 32. The hone 31 and the anvil 32 clamp a plurality of members between them, and spread energy of ultrasonic oscillation among a plurality of the members, when the hone 31 is oscillated by the oscillator 20. This energy of the ultrasonic oscillation destroys and removes oxide films on surfaces of the members, and induces diffusion of atoms between the cleaned surfaces thereby to perform welding.

Figure 2A:
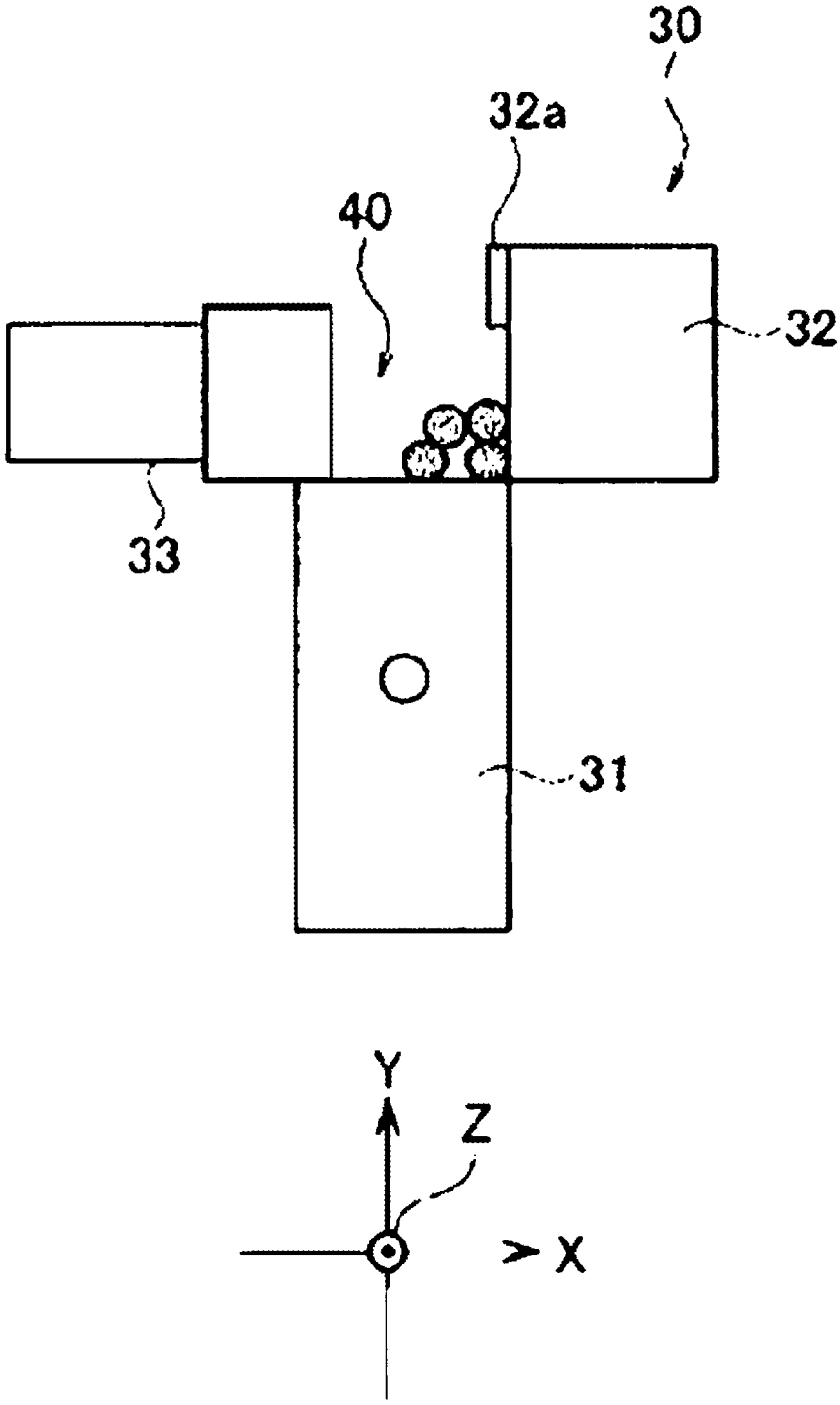
FIG. 2A is a view showing a first step in general ultrasonic welding.
Figure 2B:
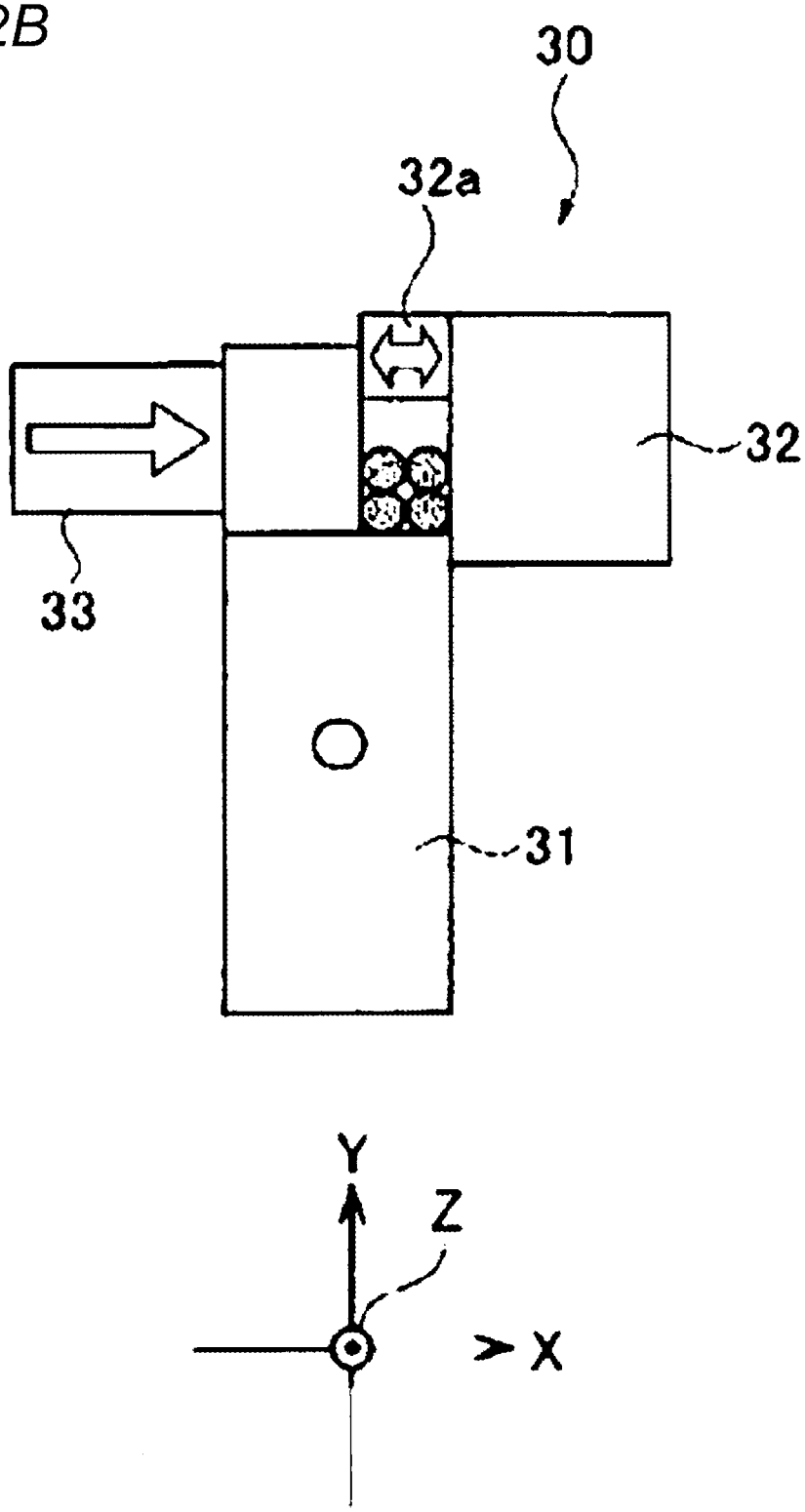
FIG. 2B is a view showing a second step in the general ultrasonic welding.
Figure 2C:
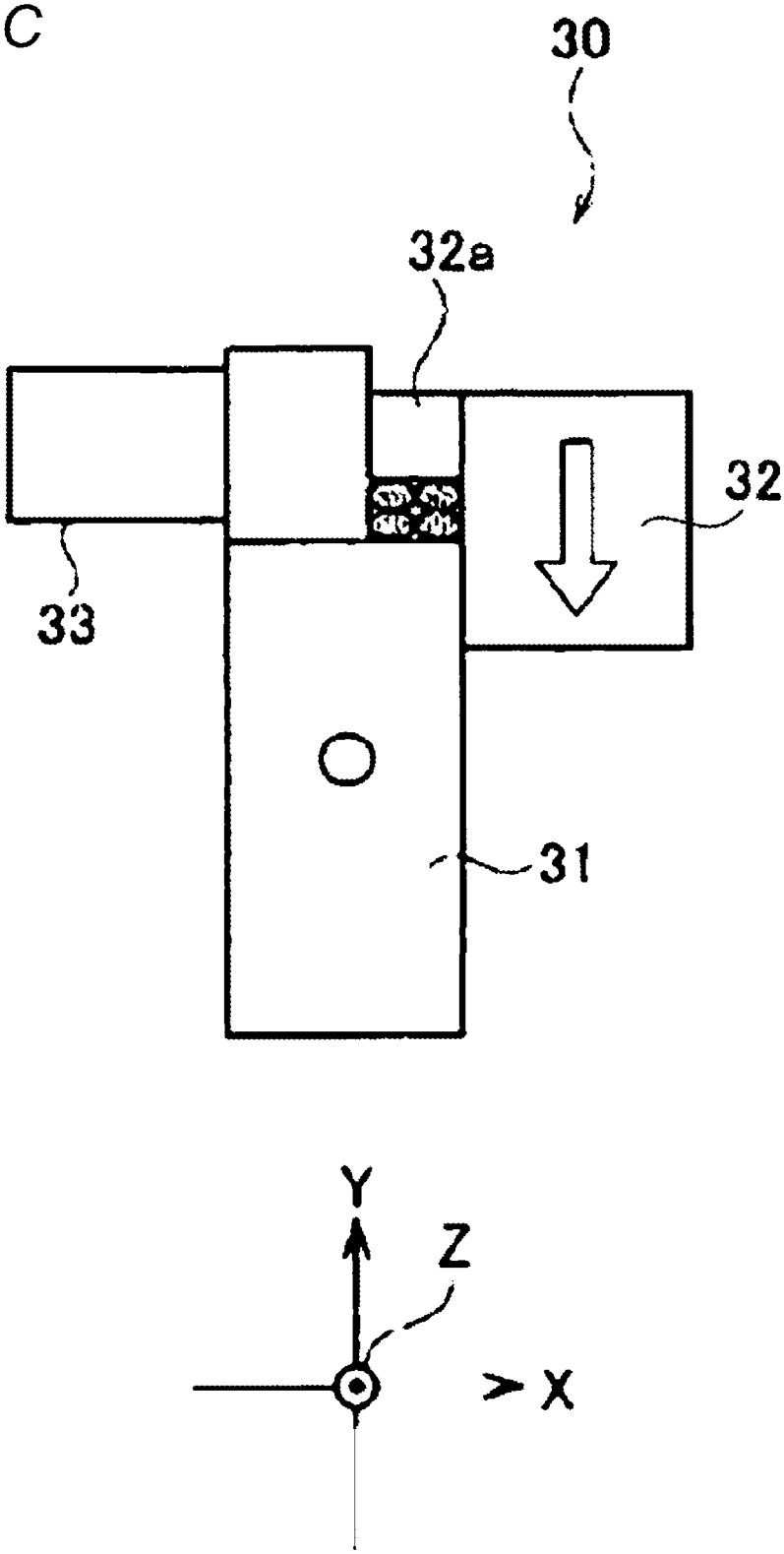
FIG. 2C is a view showing a third step in the general ultrasonic welding.

FIGS. 2A to 2C are views showing a manner of general ultrasonic welding. The ultrasonic welding part 30 is provided with a gather 33, in addition to the hone 31 and the anvil 32.

In order to conduct the ultrasonic welding, as a first step, a worker strips off coatings of a plurality of electric wires to expose conductors. Thereafter, the conductors are made adjacent to one another, and in this state, their conductor parts are inserted into a space 40 enclosed by the hone 31, the anvil 32, and the gather 33 (See FIG. 2A).

Then, the worker operates the ultrasonic welding machine 1. The ultrasonic welding machine 1 performs the following actions according to the operation of the worker. To start with, the ultrasonic welding machine 1 moves the gather 33 toward the anvil 32 (See FIG. 2B). Consequently, the conductors are restrained from moving in a lateral direction (a direction of X-axis in FIGS. 2A to 2C). Then, the ultrasonic welding machine 1 moves a pressurizing part 32*a* of the anvil 32 thereby to bring the conductors into a state blocked in a vertical direction (a direction of Y-axis in FIGS. 2A to 2C).

Thereafter, the ultrasonic welding machine 1 lowers an entirety of the anvil 32 (moves in a minus direction on the Y-axis in FIGS. 2A to 2C), and clamps the conductors in the vertical direction by means of the pressurizing part 32*a* and the hone 31 (See FIG. 2C). Then, the ultrasonic welding machine 1 transmits oscillation from the oscillator 20 to the hone 31 thereby to oscillate the hone 31 in a direction of depth (a direction of Z-axis in FIGS. 2A to 2C). As the results, oxide films on surfaces of the conductors are destroyed and removed by energy of the ultrasonic oscillation, and the conductors of a plurality of the electric wires are welded together.

Thereafter, the anvil 32 and the gather 33 are returned to their initial positions, and the worker takes out the electric wires which have been welded by ultrasonic welding.

Herein, referring to the method of connecting electric wires disclosed in Patent Document 1, the conductors of a plurality of insulated electric wires are twisted together by more than a quarter rotation in the same direction, and then, welded by ultrasonic welding. In Patent Document 1, it is so described that the ultrasonic welding is conducted by oscillating the hone 31 while the electric wires are pressurized with the anvil 32, and hence, the connecting strength is high in the direction of Y-axis interconnecting the hone 31 and the anvil 32, and not so high in the direction of X-axis. Moreover, in Patent Document 1, it is so described that by twisting the conductors together by more than a quarter rotation in the same direction, the respective conductors are contacted with one another in the direction of Y-axis, and can be welded with high connecting strength. However, only because the conductors are twisted, there is such anxiety that raw wires of the conductors may be loosened. Consequently, tight contact between the raw wires is weakened, and there remains possibility of improving the connecting strength.

In view of the above, according to the method of connecting electric wires in the embodiment, the connecting strength is improved in the following method. Specifically, in the embodiment, the conductors of the electric wires are joined together by ultrasonic welding, through a preparing step, a twisting step, and a welding step.

Figure 3A:
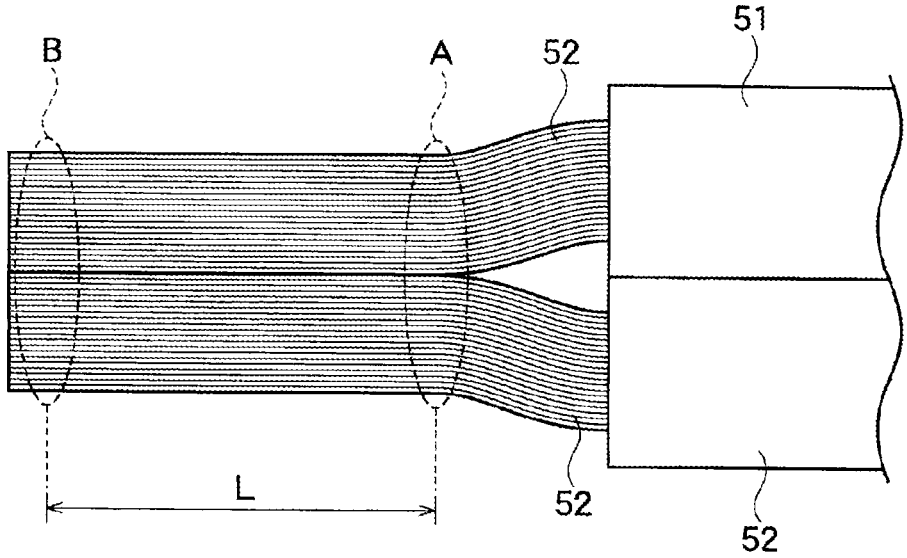
FIG. 3A is a schematic view showing a state before conductors are twisted in a twisting step in a method of connecting electric wires in an embodiment.
Figure 3B:
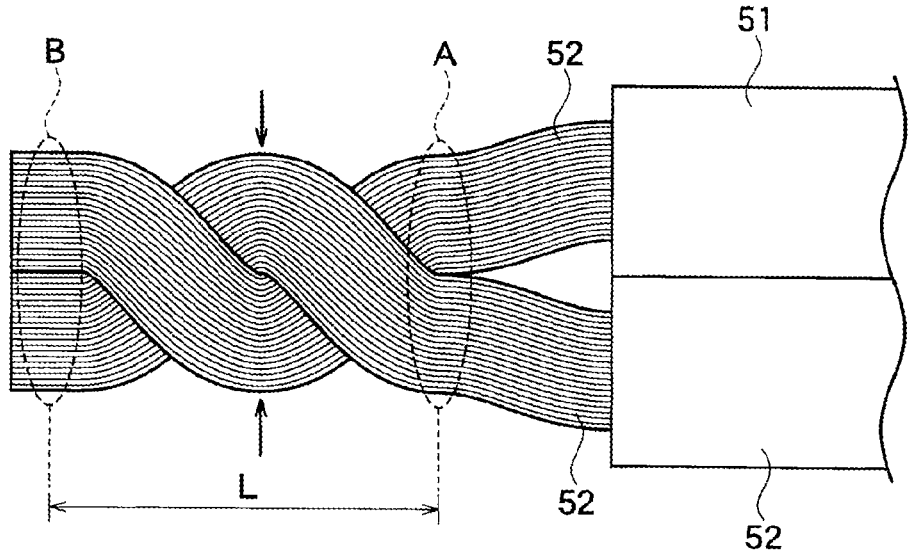
FIG. 3B is a schematic view showing a state after the conductors are twisted in the twisting step in the method of connecting electric wires in the embodiment.

FIGS. 3A and 3B are schematic views showing the method of connecting electric wires in the embodiment. It is to be noted that although the method of connecting two electric wires 51 is described in FIGS. 3A and 3B, the number of the electric wires 51 is not limited to two, but may be more than three.

As a first step, the worker strips off coatings of a plurality of the electric wires 51 thereby to expose conductors 52, as shown in FIG. 3A (the preparing step). Then, the worker allows the conductors 52 of a plurality of the electric wires 51 to be contacted with one another.

Thereafter, the worker holds two places of an assembly of the conductors 52 (hereinafter, referred to as a conductor part) of the respective electric wires 51 at a root side A and at a distal end side B, by means of a device or an instrument having holding function such as a chucking device. In this embodiment, a distance between the two places which are held is called as a between chucks distance L.

Then, the worker rotates at least one place out of the two places around the longitudinal direction of the electric wires. On this occasion, the worker twists the conductors 52 together in the same direction, while the between chucks distance L is kept constant. In this manner, the conductors 52 are twisted together, as shown in FIG. 3B.

Because the between chucks distance L is kept constant on this occasion, a force is applied so that the two conductors 52 may be compressed inward. Specifically, conductor density (a ratio of the conductor 52 with respect to a circumcircle of the conductor which is perpendicular to the longitudinal direction of the electric wires 51) is enhanced.

Then, the worker welds the exposed conductor part by ultrasonic welding, using the ultrasonic welding machine 1, as described referring to FIGS. 1 and 2 (the welding step). Because the conductor density is enhanced when the ultrasonic welding is conducted, energy of the ultrasonic oscillation can easily spread between the conductors 52. As the results, the conductors 52 are favorably joined together, and the connecting strength can be improved.

Figure 4A:
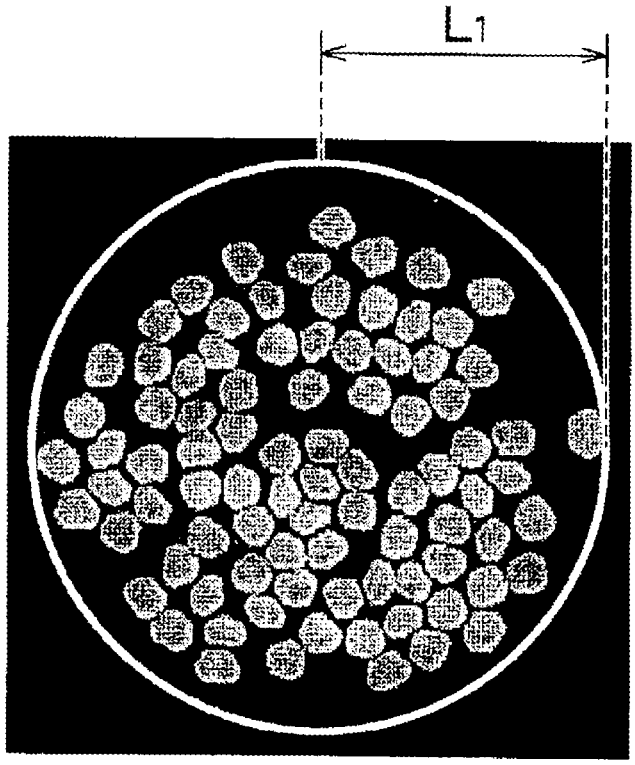
FIG. 4A is a view showing a cross section when the conductors are held and rotated by about one rotation, without keeping a between chucks distance constant.
Figure 4B:
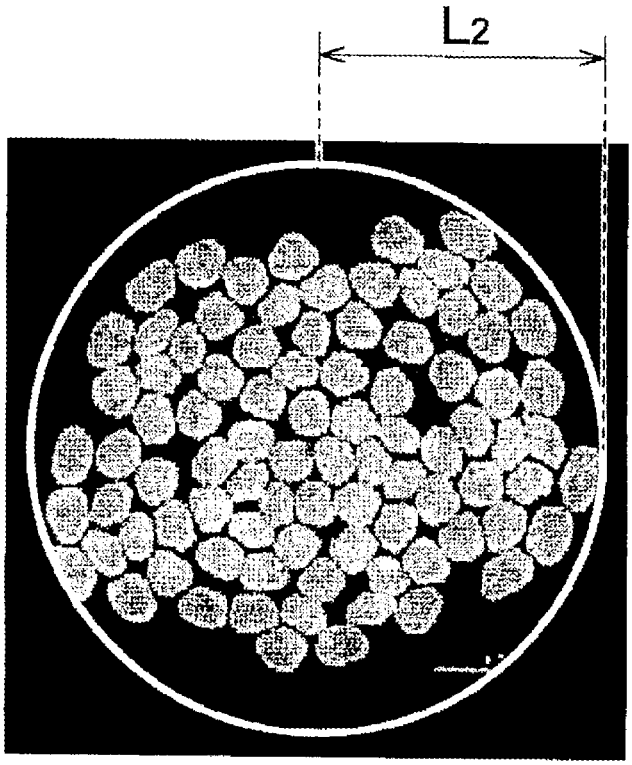
FIG. 4B is a view showing a cross section when the conductors are held and rotated by about one rotation, while keeping the between chucks distance constant.

FIGS. 4A and 4B are views showing a cross section of the conductors, when the conductors 52 are held and rotated by about one rotation. In FIGS. 4A and 4B, there is shown a cross section of the conductors, when the conductors 52 of eight electric wires formed of aluminum having 0.75 sq (that is, a sectional area of the conductor is 0.75 $mm^2$) are twisted together. By comparing FIG. 4A and FIG. 4B, it is found that the conductor density becomes high in case where the between chucks distance L is kept constant.

As shown in FIG. 4A, in case where the conductors 52 are twisted together without keeping the between chucks distance L constant, distances between raw wires of the conductors 52 are increased. On the other hand, as shown in FIG. 4B, in case where the conductors 52 are twisted together while keeping the between chucks distance L constant, the distances between the raw wires of the conductors 52 are decreased.

In this case, although the size and number of the raw wires are the same in FIGS. 4A and 4B, radiuses $L_1$, $L_2$ of the circumcircles are different in both cases. Specifically, provided that total sectional area of the raw wires is C, the conductor density is $C/\pi L_1^2$, in case of an example in FIG. 4A, and the conductor density is $C/\pi L_2^2$, in case of an example in FIG. 4B. When the conductor densities in both the examples are calculated, there occurs a difference of about 1.33 times between the conductor densities in both the examples.

Figure 5A:
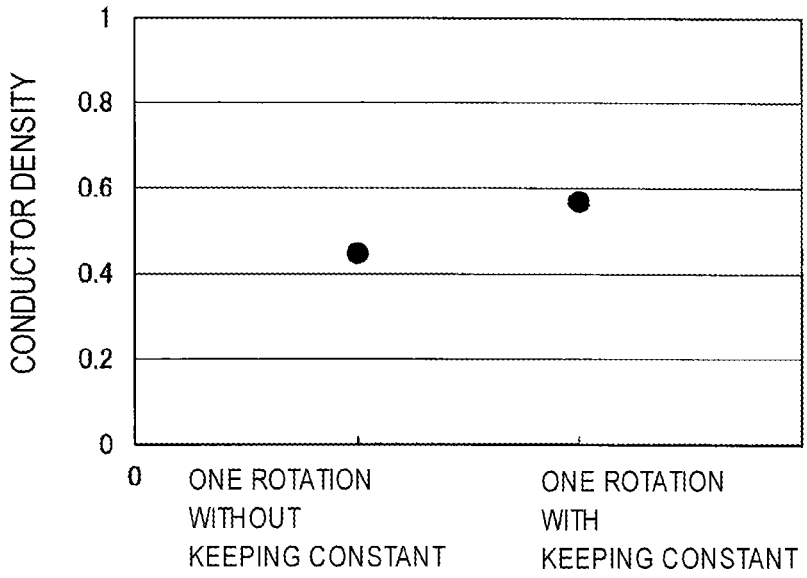
FIG. 5A is a graph showing conductor density.
Figure 5B:
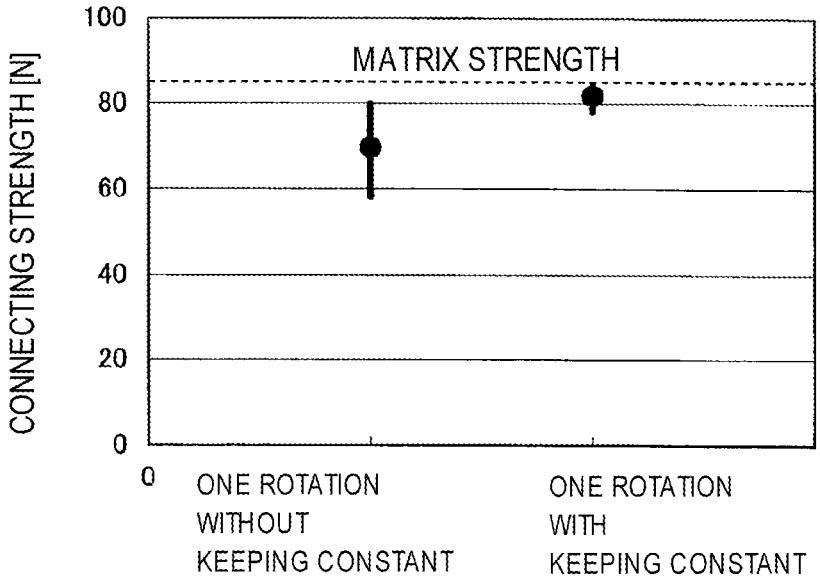
FIG. 5B is a graph showing connecting strength.

FIGS. 5A and 5B are graphs respectively showing the conductor density and the connecting strength. It is to be noted that in FIGS. 5A and 5B, the conductor density, when the conductors of the eight electric wires of aluminum having 0.75 sq are twisted together, is shown, in the same manner as in FIGS. 4A and 4B, and at the same time, the connecting strength of the electric wire for evaluation is shown, provided that one of the eight electric wires is an electric wire for evaluation.

As shown in FIG. 5A, when the conductors 52 are twisted together without keeping the between chucks distance L constant, the conductor density is about 0.43. On the other hand, when the conductors 52 are twisted together while keeping the between chucks distance L constant, the conductor density is about 0.57.

Moreover, as shown in FIG. 5B, when the conductors 52 are twisted together and welded by ultrasonic welding without keeping the between chucks distance L constant, the smallest connecting strength is about 58N (matrix strength ratio is about 68%), and the largest connecting strength is about 79N (the matrix strength ratio is about 92%). On the other hand, when the conductors 52 are twisted together, while keeping the between chucks distance L constant, and welded by ultrasonic welding, the smallest connecting strength is about 79N (the matrix strength ratio is about 93%), and the largest connecting strength is about 85N (the matrix strength ratio is about 100%).

In this manner, in case where the between chucks distance L is not constant, an average connecting strength can be about 69N, while in case where the between chucks distance L is constant, the average connecting strength is enhanced to about 82N. As the results, when the conductors 52 are twisted together while keeping the between chucks distance L constant prior to the ultrasonic welding, the conductor density is enhanced, and the connecting strength after the ultrasonic welding is improved.

Figure 6:
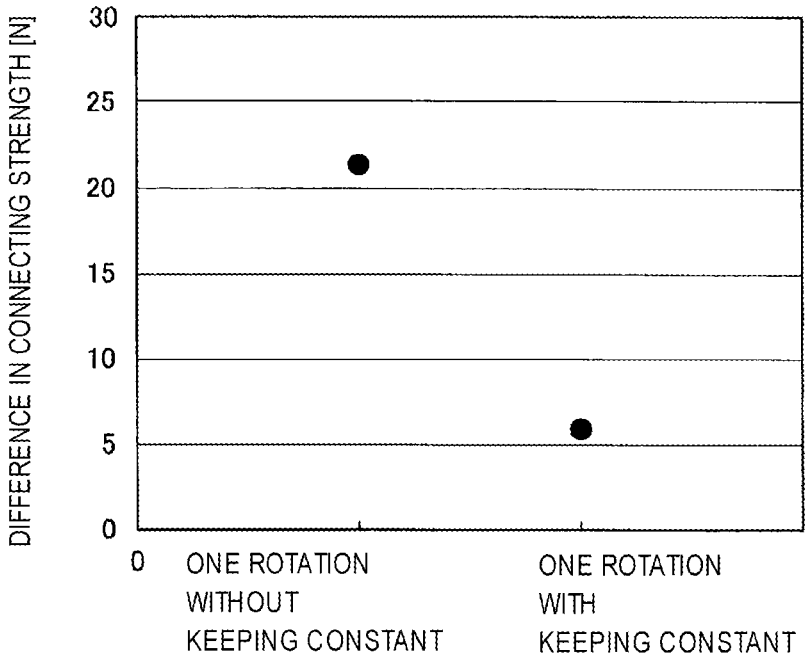
FIG. 6 is a view showing dispersion of the connecting strength by way of differences in the connecting strength.

FIG. 6 is a view showing dispersion of the connecting strength by way of differences in the connecting strength. As shown in FIG. 6, in case where the between chucks distance L is not constant, the dispersion (a difference in the connecting strength) is 21N, and in case where the between chucks distance L is constant, the dispersion stays at 7N. As the results, the dispersion is depressed.

In the twisting step, it is desirable that the conductors 52 are twisted together so that the conductor density may be more than or equal to 0.6 and less than 1.0. In case where the conductors 52 are twisted together without keeping the between chucks distance L constant, the conductor density is about 0.4, for example. Therefore, by twisting the conductors 52 together so that the conductor density may be more than or equal to 0.6 and less than 1.0 while keeping the between chucks distance L constant, the density is apparently enhanced as compared with the case where the between chucks distance L is not kept constant, and the connecting strength can be apparently improved.

Moreover, in the twisting step, it is more desirable that the conductors 52 are twisted together so that the conductor density may be more than or equal to 0.8 and less than 0.9. This is because the density is apparently enhanced as compared with the case where the between chucks distance L is not kept constant, and the connecting strength can be apparently improved.

Figure 7A:
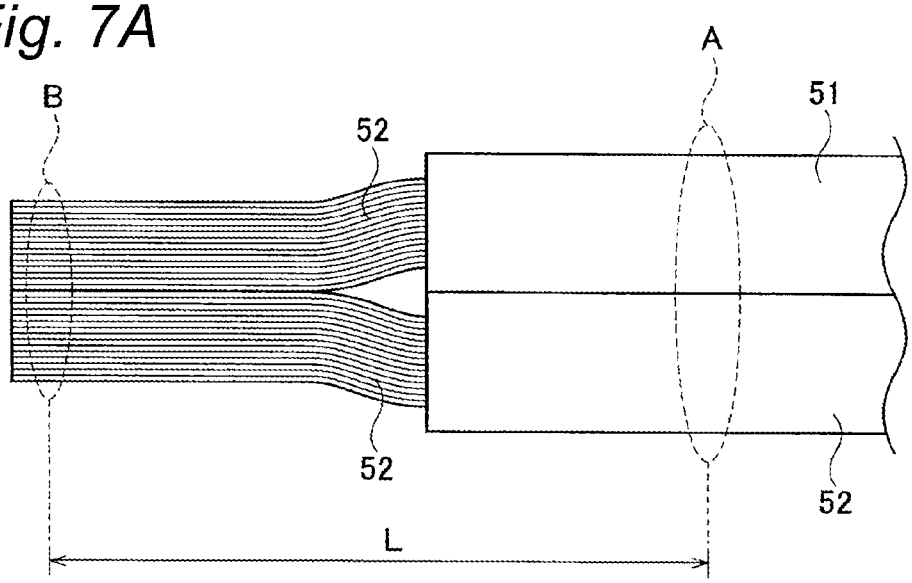
FIG. 7A is a view showing a state before the conductors are twisted in the twisting step in a second method of connecting electric wires in the embodiment.
Figure 7B:
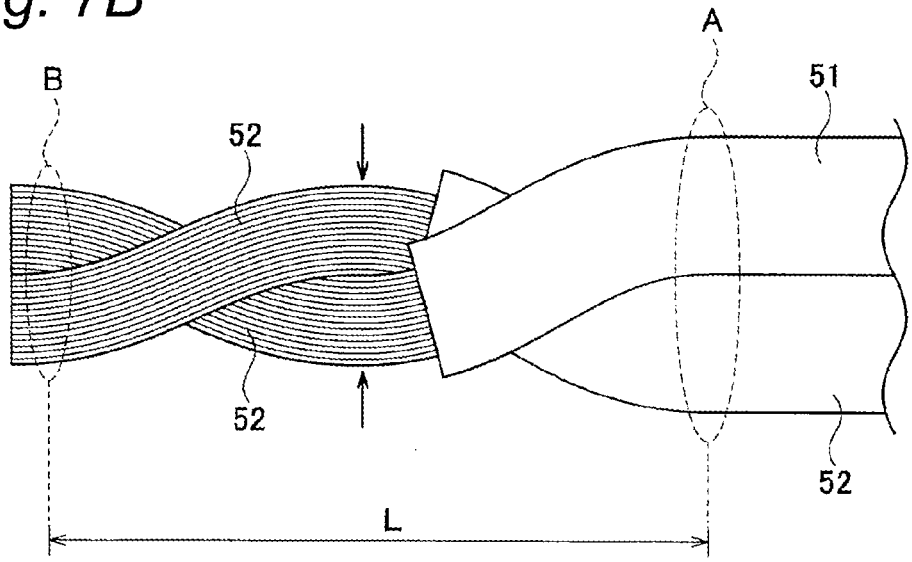
FIG. 7B is a view showing a state after the conductors are twisted in the twisting step in the second method of connecting electric wires in the embodiment.

FIGS. 7A and 7B are schematic views showing a second method of connecting the electric wire 51 in the embodiment. Although the method of connecting the two electric wires 51 is described in FIGS. 7A and 7B, the number of the electric wires 51 is not limited to two, but may be more than three.

As a first step, the worker strips off the coatings of a plurality of the electric wires 51 thereby to expose the conductors 52, as shown in FIG. 7A (the preparing step). Then, the worker allows the conductors 52 of a plurality of the electric wires 51 to be contacted with one another.

Thereafter, the worker holds two places of the electric wires at a coating part A and at a distal end side B of the conductor part, by means of a device or an instrument having holding function such as a chucking device. Then, the worker rotates at least one place out of the two places around the longitudinal direction of the electric wires. On this occasion, the worker twists the conductors 52 together in the same direction, while keeping the between chucks distance L constant (the twisting step). In this manner, the conductors 52 are twisted together as shown in FIG. 7B.

Because the between chucks distance L is kept constant on this occasion, a force is applied so that the two conductors 52 are compressed inward. This means that the conductor density is enhanced. Particularly, in case where the between chucks distance L is short, an amount of rotation when the conductors are twisted must be small, and dispersion may occur in the conductor density too, due to dispersion of the rotation amount. However, in case of an example in FIG. 7, the between chucks distance L is made long, and the dispersion of the conductor density can be reduced, even though subtle dispersion of the rotation amount occurs.

It is to be noted that the method of connecting the electric wires 51 is not limited to the examples as shown in FIGS. 3A, 3B, 7A and 7B, but it is also possible to hold the conductors 52, by opposing a plurality of the electric wires 51 to one another, and to twist the conductors together.

As described above, according to the method of connecting electric wires in the embodiment, there is the twisting step for twisting the conductors 52 together while keeping the between chucks distance L constant, after the preparing step and before the welding step. Therefore, the conductor density (the ratio of the conductor 52 with respect to the circumcircle of the conductor which is perpendicular to the longitudinal direction of the electric wires 51) is enhanced prior to the ultrasonic welding, and the energy of the ultrasonic oscillation can be easily spread among the conductors 52. As the results, the conductors 52 are favorably joined, and the connecting strength can be improved. Further, spreading efficiency of the energy of the ultrasonic oscillation is enhanced, and therefore, the electric wires in which the connecting strength is weak, are decreased in number, and dispersion of the connecting strength can be also depressed.

Moreover, the conductors 52 are twisted together so that the conductor density may be more than or equal to 0.6 and less than 1.0. In case where the conductors 52 are twisted together without keeping the between chucks distance L constant, the conductor density is about 0.4, for example. Therefore, by twisting the conductors 52 together so that the conductor density may be more than or equal to 0.6 and less than 1.0, while keeping the between chucks distance L constant, the density is apparently enhanced as compared with the case where the between chucks distance L is not kept constant, and the connecting strength can be apparently enhanced.

Moreover, the conductors 52 are twisted together so that the conductor density may be more than or equal to 0.8 and less than 0.9. Therefore, the density is apparently enhanced, as compared with the case where the between chucks distance L is not kept constant, and the connecting strength can be apparently improved.

Moreover, the conductors 52 are twisted together by at least one rotation, while keeping the between chucks distance L constant. In this case, it is already known that after one rotation, the conductor density is about 0.6, and the connecting strength can be apparently improved. Additionally, there is no necessity of twisting in view of the conductor density, and the connecting strength can be easily improved.

Further, in the twisting step, after the conductors 52 are contacted with one another, at least two places of only the conductor part are held, and then, at least one place out of the two places is rotated around the longitudinal direction of the electric wires 51. Accordingly, only the conductor part is rotated. In this case, when both the conductor part and the coating part are held and rotated, the distance between the two places becomes longer, and the rotation amount for the purpose of enhancing the conductor density by a determined amount is increased. However, because only the conductor part is held and rotated, the rotation amount for the purpose of enhancing the conductor density can be reduced, and an increase of working steps can be depressed.

Moreover, in the twisting step, after the conductors 52 are contacted with one another, at least one place of the conductor part and at least one place of the coating part are held, and then, at least one of the two places is rotated around the longitudinal direction of the electric wires 51. In case where only the conductor part is held, the between chucks distance L becomes short. For this reason, it is impossible to excessively increase the rotation amount so that the conductor part may not be damaged. As the results, dispersion of the conductor density may occur with high possibility, due to subtle dispersion of the rotation amount. However, because both the conductor part and the coating part are held, the distance can be secured in the longitudinal direction of the electric wires 51, as compared with the case where only the conductor part is held, and the rotation amount can be also increased. In this manner, the dispersion of the conductor density even due to subtle dispersion of the rotation amount is decreased. As the results, it is possible to obtain a desired conductor density.

Although the invention has been herein described referring to the embodiment, the invention is not limited to the above described embodiment, but modifications may be added within a scope not deviating from gist of the invention. For example, although in the above described embodiment, the method of connecting the electric wires 51 formed of aluminum is described by way of example, the invention is not limited to this, but can be applied to connection between electric wires of copper, and connection between electric wires of aluminum and electric wires of copper.

Moreover, although in the above described embodiment, the method of connecting the electric wires 51 having 0.75 sq is described by way of example, the sectional area of the electric wire is not limited to 0.75 sq, but may be of other sizes. Further, although in the above described embodiment, the two places of the conductors 52 are held when they are twisted together, the invention is not limited to this, but more than three places may be held by adding a support or the like.

This invention is based on Japanese Patent Application (Application No. 2009-034472) filed on Feb. 17, 2009, the contents of which are hereby incorporated by way of reference.

DESCRIPTION OF THE REFERENCE NUMERALS

1 Ultrasonic welding machine
10 Power supply
20 Oscillator
30 Ultrasonic welding part
31 Hone
32 Anvil
32*a* Pressurizing part
33 Gather
40 Space
51 Electric wire
52 Conductor
L Between chucks distance

What is claimed is:

1. A method of connecting electric wires, comprising:

a step for removing coatings of a plurality of the electric wires thereby to expose conductors;

a step for holding at least two places of a plurality of the electric wires;

a step for twisting the conductors together in the same direction while keeping a distance between the two holding places constant, in the twisting step a force is applied to the conductors such that the conductors are compressed inward; and a step for welding the conductors together by ultrasonic welding, wherein a first electric wire from the plurality of electric wires is positioned above a second electric wire from the plurality of electric wires at one of the at least two holding places, and wherein at another of the at least two holding places the first electric wire is positioned above the second electric wire after the twisting step.

2. The method of connecting electric wires according to claim 1, wherein in the twisting step, the conductors are twisted together so that a conductor density is more than or equal to 0.6 and less than 1.0.

3. The method of connecting electric wires according to claim 2, wherein in the twisting step, the conductors are twisted together so that the conductor density is more than or equal to 0.8 and less than 0.9.

4. The method of connecting electric wires according claim 1, wherein in the twisting step, the conductors are twisted together by at least one rotation, while keeping the distance between the holding places constant.

5. The method of connecting electric wires according to claim 1, wherein in the twisting step, in a state where at least two places of only a conductor part are held after the conductors of a plurality of the electric wires are contacted with one another, at least one of the two places is rotated around a longitudinal direction of the electric wires thereby to twist the conductors together, while keeping the distance between the holding places constant.

6. The method of connecting electric wires according to claim 1, wherein in the twisting step, in a state where at least one place of the conductor part and at least one place of the coating part are held after the conductors of a plurality of the electric wires are contacted with one another, at least one of the respective places is rotated around a longitudinal direction of the electric wires thereby to twist the conductors together, while keeping the distance between the holding places constant.

* * * * *